US005982330A

United States Patent [19]

Koyanagi et al.

[11] Patent Number: 5,982,330

[45] **Date of Patent: *Nov. 9, 1999**

[54] ANTENNA APPARATUS

[75] Inventors: Yoshio Koyanagi, Kanagawa; Koichi Ogawa, Osaka; Masazumi Yamazaki, Kanagawa, all of Japan

[73] Assignee: Matsushita Electric Co., Ltd., Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/929,698

[22] Filed: Sep. 15, 1997

[30] Foreign Application Priority Data

Sep. 19, 1996 [JP] Japan ..... 8-248407

[51] Int. Cl.[6] ..... H01Q 1/24

[52] U.S. Cl. ..... 343/702; 343/895

[58] Field of Search ..... 343/702, 895, 343/900, 901; H01Q 1/24, 1/10

[56] References Cited

U.S. PATENT DOCUMENTS

| | | | |
|---|---|---|---|
| 5,504,494 | 4/1996 | Chatzipetros et al. | 343/702 |
| 5,594,459 | 1/1997 | Hirota | 343/702 |
| 5,650,789 | 7/1997 | Elliott et al. | 343/702 |

*Primary Examiner*—Hoanganh Le
*Attorney, Agent, or Firm*—Pearne, Gordon, McCoy & Granger LLP

[57] ABSTRACT

In an antenna apparatus, a monopole antenna element connected to an antenna matching circuit via a first contact 105 when a whip antenna is extended; a helical antenna element connected to the antenna matching circuit via a second contact when the whip antenna is accommodated; and a parasitic helical element disposed in close proximity to the helical antenna element at a spacing which is sufficiently small with respect to the wavelength of a first frequency band of a radio circuit.

6 Claims, 16 Drawing Sheets

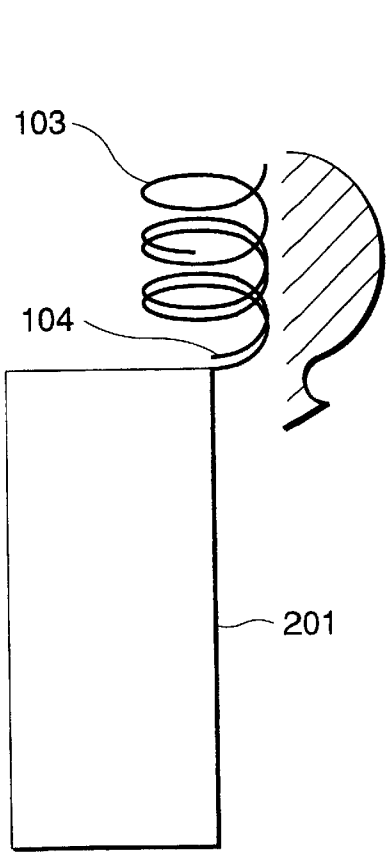
FIG.7D
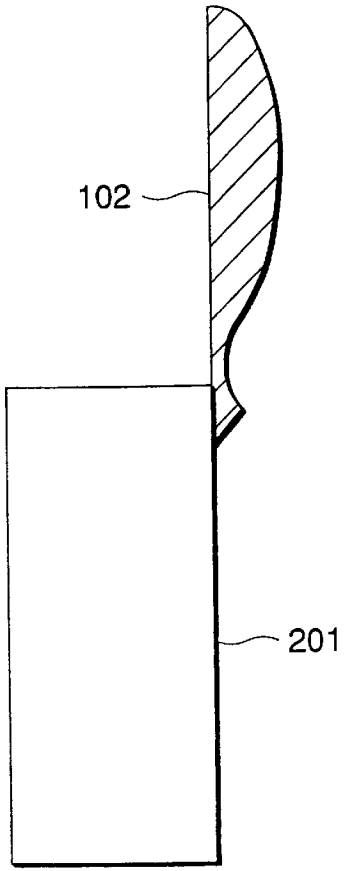
FIG.7C
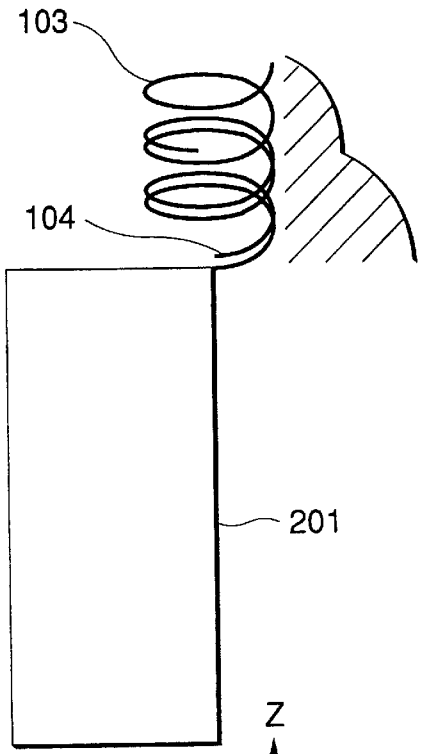
FIG.7B
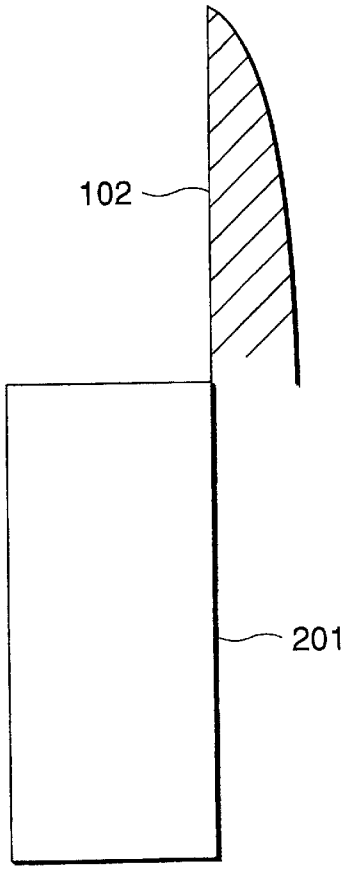
FIG.7A
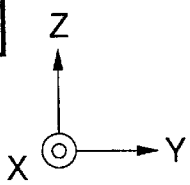

ANTENNA APPARATUS

BACKGROUND OF THE INVENTION

1. Field of the Invention

The present invention relates to a whip antenna of a telescopic type which is mainly used in a mobile radio unit, and more particularly to an antenna apparatus which is arranged to be capable of coping with a plurality of frequency bands.

2. Description of the Related Art

In recent years, there has been an increasing demand for mobile radio units such as a cellular telephone set. As antennas which are used for such mobile radio units, linear whip antennas which can be accommodated in main bodies of the portable units are widely used.

Hereafter, as a conventional example, a description will be given of the configuration disclosed in Unexamined Japanese Patent Publication (kokai) No. Hei. 1-204504 with reference to FIGS. 13 and 14. It should be noted that these drawings are shown as FIGS. 2 and 4 in Unexamined Japanese Patent Publication (kokai) No. Hei. 1-204504. In addition, the reference numerals in the drawings are identical to those used in the reference.

As shown in FIG. 13, when an antenna element 14 is pulled out from a main body 10 of a telephone set, a contact member 15 is in contact with a contact piece 21*a*. Accordingly, the antenna element 14 is connected to a matching circuit assembly 12. On the other hand, when the antenna element 14 is accommodated in the main body 10 of the telephone set as shown in FIG. 14, a contact member 16 is in contact with a contact piece 21*b*. Consequently, the antenna element 14 is connected to the matching circuit assembly 12. Thus, the antenna element 14 is connected to the matching circuit assembly 12 not only when the antenna element 14 is pulled out from the main body 10 of the telephone set, but also when it is accommodated in the main body 10 of the telephone set.

In the above-described configuration, if the impedance when the antenna element 14 is viewed from the matching circuit assembly 12 with the antenna element 14 pulled out from the main body 10 of the telephone set is assumed to be Z1, and the impedance when the antenna element 14 is viewed from the matching circuit assembly 12 with the antenna element 14 accommodated in the main body 10 of the telephone set is assumed to be Z2, and if the element length of the antenna element 14, the feeding-point position, and the dimensions of a casing of the radio unit, and the like are configured such that Z1 becomes equal to Z2, then it is possible to obtain a favorable matched state by virtue of the matching circuit assembly 12 even in cases where the antenna element 14 has been pulled out from the main body 10 of the telephone set and it is accommodated in the main body 10 of the telephone set. Consequently, high-quality and stable mobile communication is possible.

However, in conjunction with the diversification of mobile communications, frequency bands which are used have also become diversified including, for example, an 800 MHz band, a 1.5 GHz band, and a 1.9 GHz band. For this reason, there has been a demand for radio units capable of jointly using systems with different frequency bands. In contrast, conventional antennas are adapted to cope with only one frequency band. Hence, if such an antenna is used in a radio unit which is capable of jointly using a plurality of systems, its characteristics deteriorate appreciably.

FIG. 15 shows the frequency characteristics of impedance when the antenna element 14 is viewed from the matching circuit assembly 12 with the antenna element 14 pulled out from the main body 10 of the telephone set and with antenna element 14 accommodated in the main body 10 of the telephone set. The graph shown in FIG. 15 is called a Smith chart, wherein the ranges R=0 to +∞ and X−∞ to +∞ under the impedance Z=R+jX are mapped in a unit circle, and this chart is popularly used to indicate the impedance. The solid line in the chart shows the locus of impedance Z1(f) when the antenna element 14 is viewed from the matching circuit assembly 12 with the antenna element 14 pulled out from the main body 10 of the telephone set. Meanwhile, the broken line shows the locus of impedance Z2(f) when the antenna element 14 is viewed from the matching circuit assembly 12 with the antenna element 14 accommodated in the main body 10 of the telephone set. In addition, the marker shown by a filled circle (•) shows the impedance of the center frequency fA of the frequency band A, while the marker shown by a cross (x) shows the impedance of the center frequency fB of the frequency band B.

As shown in FIG. 15, Z1(f) and Z2(f) depict different loci due to the differences in the feeding position of the antenna element 14 and the surrounding environment. For this reason, even if the element length of the antenna element 14 and the dimensions of the casing of the main body 10 of the telephone set are determined such that Z1(fA)=Z2(fA) at the center frequency fA in the frequency band A, the impedance at the center frequency fB in the frequency band B becomes such that Z1(fB)≠Z2(fB). For this reason, only one matching circuit can be prepared with respect to two antenna impedances in the state in which the antenna element 14 is pulled out from the main body 10 of the telephone set and in the state in which it is accommodated in the main body 10 of the telephone set. Hence, there have been problems in that a favorable matched state cannot be obtained in either one state or in both states, that the modulation accuracy and reception sensitivity deteriorates, and that the communication quality becomes aggravated.

SUMMARY OF THE INVENTION

The present invention is aimed at overcoming the above-described problems, and it is an object of the present invention to provide an antenna apparatus which is capable of independently controlling the impedances of an antenna element in two frequency bands, and is hence able to obtain a desired impedance irrespective of the external design of the radio unit, and which is capable of allowing the impedances to match in the pulled-out and accommodated states of the antenna element to obtain a favorable matched state, thereby permitting high-quality and stable mobile communication.

An antenna apparatus which is a telescopic whip antenna corresponding to first and second frequency bands used in a compact portable radio, comprising: a monopole antenna element connected to an antenna matching circuit via a first contact when the whip antenna is extended from a body of the antenna apparatus; a helical antenna element connected to the antenna matching circuit via a second contact when the whip antenna is accommodated in the body of the antenna apparatus; and a parasitic helical element disposed in close proximity to the helical antenna element at a spacing which is sufficiently small with respect to a wavelength of the first frequency band of a radio circuit.

In accordance with the present invention, since the parasitic helical element is used in the antenna apparatus used for a mobile radio unit, advantages are obtained in that it is possible to control the impedance of the antenna element, and that since the impedances in the extended and accommodated states of the antenna element are matched, it is possible to realize a favorable matching in a plurality of frequency bands, thereby permitting high-quality and stable mobile communication.

BRIEF DESCRIPTION OF THE INVENTION

In the accompanying drawings:

FIGS. 7A to 7D are diagrams illustrating the distributions of electric current in the antenna apparatus in accordance with the second embodiment of the present invention;

DETAILED DESCRIPTION OF THE INVENTION

Figure 1:
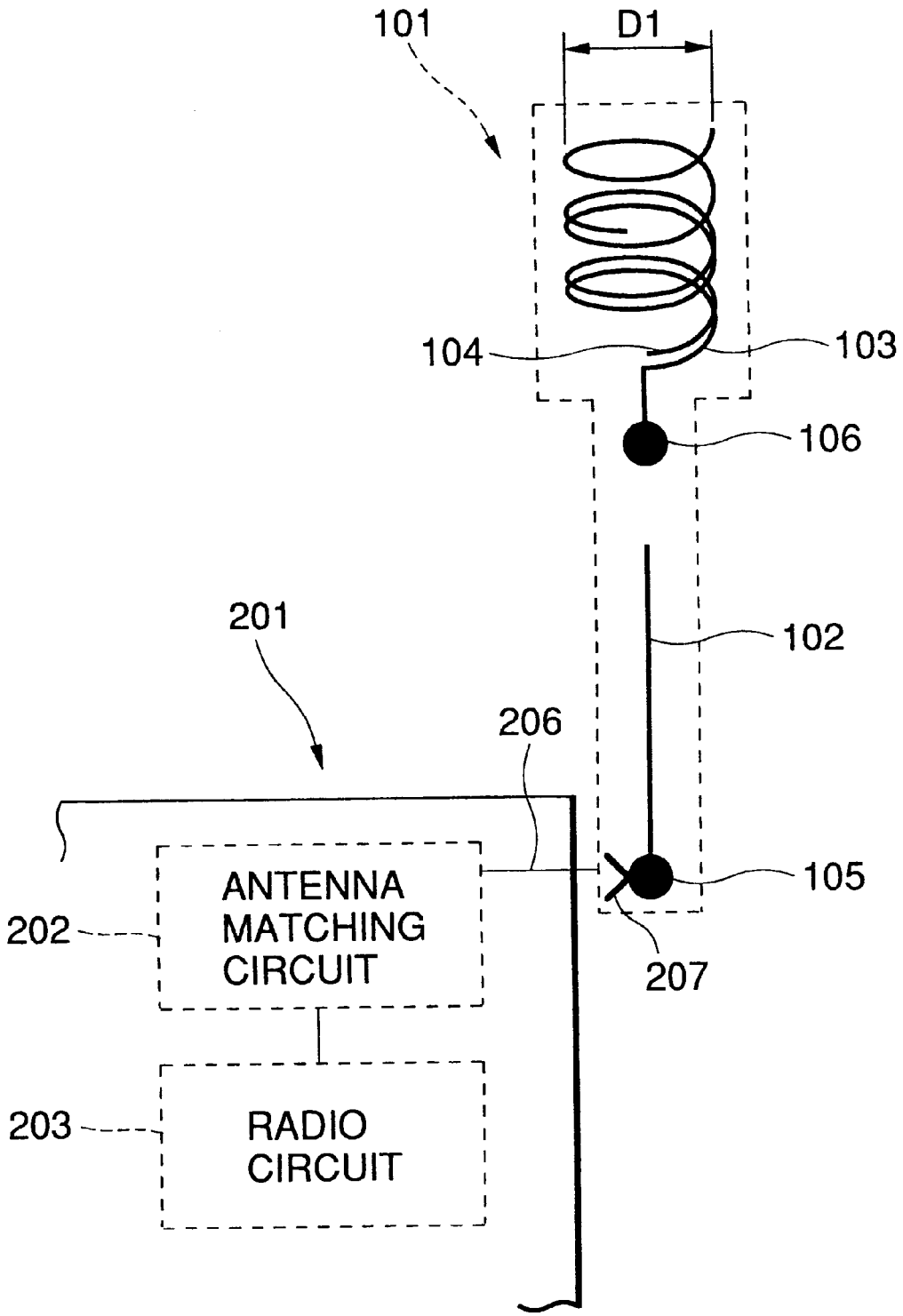
FIG. 1 is a conceptual diagram of an antenna apparatus in accordance with a first embodiment of the present invention.

Detailed description of the present invention will be described referring to the accompanying drawings as follows.

In the present invention, in an antenna apparatus used in a mobile radio unit, the impedance of the antenna element can be controlled by using a parasitic helical element. In addition, impedances are matched in the extended and accommodated states of the antenna element. Hence, an advantage is obtained in that a favorable matching can be realized in a plurality of frequency bands, thereby permitting high-quality and stable mobile communication.

In accordance with the present invention, there is provided an antenna apparatus with a telescopic whip antenna used in a compact portable radio unit and corresponding to first and second frequency bands, having: a monopole antenna element connected to an antenna matching circuit via a first contact when the whip antenna is extended; a helical antenna element connected to the antenna matching circuit via a second contact when the whip antenna is accommodated; and a parasitic helical element disposed in close proximity to the helical antenna element at a spacing which is sufficiently small with respect to a wavelength of the first frequency band of a radio circuit. Accordingly, the antenna apparatus offers an operational advantage in that impedances in the first frequency band of the helical antenna element can be respectively independently controlled without affecting impedances in the first frequency band of the monopole antenna element.

In accordance with the present invention, in the antenna apparatus according to claim 1, a first impedance of the parasitic helical element is adjusted such that the first impedance the helical antenna element with the whip antenna accommodated matches a second impedance of the monopole antenna element with the whip antenna extended in both the first frequency band and the second frequency band. Accordingly, since the impedances in the first frequency band and the second frequency band of the monopole antenna element can be matched respectively, the antenna apparatus offers an operation advantage in that it is possible to establish a favorable matching when the whip antenna is extended and when it is accommodated, by using an identical antenna matching circuit.

In accordance with the present invention, in the above antenna apparatus, the parasitic helical element is disposed on an inner side of the helical antenna element. Accordingly, since the coil pitch of the parasitic helical element and the coil pitch of the helical antenna element can be selected freely, the antenna apparatus offers an operational advantage in that it is possible to provide control independently in a more detailed fashion.

In accordance with the present invention, in the above antenna apparatus, the parasitic helical element is disposed on an outer side of the helical antenna element. Accordingly, since the coil pitch of the parasitic helical element and the coil pitch of the helical antenna element can be selected freely, the antenna apparatus offers an operational advantage in that it is possible to provide control independently in a more detailed fashion.

First Embodiment

Referring now to FIGS. 1 to 5, a description will be given of a first embodiment. FIG. 1 shows the configuration of an antenna apparatus in accordance with the first embodiment of the present invention. A whip antenna 101 is constituted by a monopole antenna element 102, a helical antenna element 103, and a parasitic helical element 104. Here, when the whip antenna 101 is extended, the monopole antenna element 102 is connected at a first contact 105 to an antenna matching circuit 202 via a feeding contact piece 207 and a feeder 206 which are set in a main body 201 of a radio unit. In addition, when the whip antenna 101 is accommodated in a telephone set, the helical antenna element 103 is connected at a second contact 106 to the antenna matching circuit 202 via the feeding contact piece 207 and the feeder 206. The antenna matching circuit 202 is connected to a radio circuit 203 which is operated in a frequency band A. Further, the antenna matching circuit 202 has a characteristic of converting the impedance of the monopole antenna element 102 into a desired impedance in the frequency band A, and has a characteristic of converting the impedance of the helical antenna element 103, which occurred due to electrical coupling with the parasitic helical element 104, into a desired impedance.

Figure 2A:
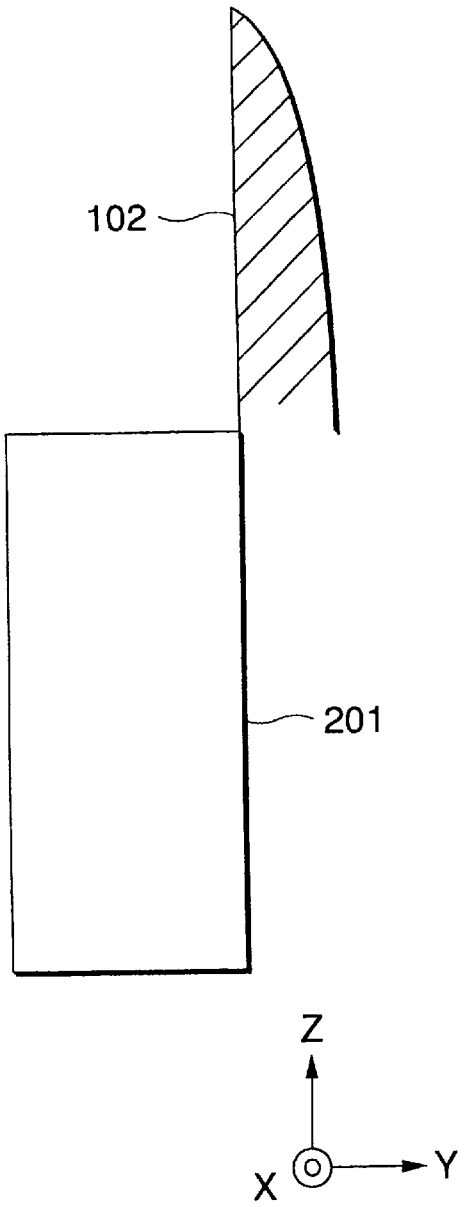
FIGS. 2A and 2B are diagrams illustrating the distributions of electric current in the antenna apparatus in accordance with the first embodiment of the present invention.
Figure 2B:
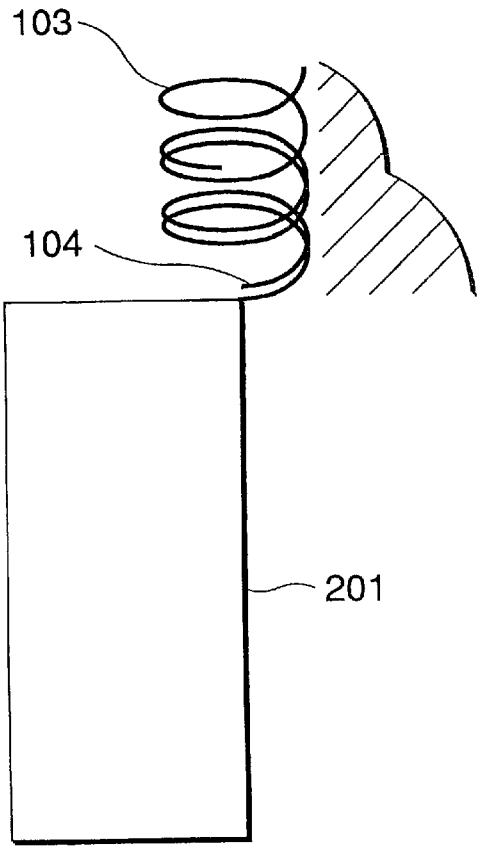

FIGS. 2A and 2B are for explaining the operation in accordance with this embodiment, and illustrate distributions of electric current when high-frequency power in the frequency band A is fed to the whip antenna 101. Incidentally, portions corresponding to those shown in FIG. 1 are denoted by the same reference numerals. FIG. 2A shows the state in which the whip antenna 101 is extended, while FIG. 2B shows the state in which the whip antenna 101 is accommodated. Here, reference numeral 201 denotes a metal plate which simulates a casing of the main body of the radio unit and has a height of 129 mm and a width of 32 mm in terms of its dimensions. Further, the monopole antenna element 102 has an element length of 115 mm; the helical antenna element 103 has a coil diameter of 7 mm, a coil pitch of 3 mm, and a coil height of 11.3 mm; and the parasitic helical element 104 has a coil diameter of 7 mm, a coil pitch of 4 mm, and a coil height of 8.1 mm. All of these elements are formed of a metal wire having a diameter of 0.5 mm, and are arranged on the same line. In addition, a center frequency f1 of the frequency band A is set at 850 [MHz]. Further, the swollen portion at the slanted-line portion shows the magnitude of electric current on the elements including the monopole antenna element 102 and the helical antenna element 103.

The high-frequency power in the frequency band A fed to the monopole antenna element 102 produces a distribution of electric current in correspondence with its virtual equivalent electrical length. In the case of FIG. 2A, since the virtual equivalent electrical length of the monopole antenna element 102 is a ¼ wavelength, the distribution of electric current at the point of connection to the main body 201 of the radio unit becomes maximum. Similarly, also in the case of FIG. 2B in which the whip antenna 101 is accommodated, the distribution of electric current of the helical antenna element 103 becomes maximum at the point of connection to the main body 201 of the radio unit due to the effect of the current which is induced in the parasitic helical element 104.

The high-frequency current induced in the parasitic helical element 104 affects the current distribution in the helical antenna element 103 and the impedance thereof. Here, since the amplitude and phase of the high-frequency current can 20 be controlled by the length and pitch of the parasitic helical element 104, the impedance of the helical antenna element 103 can be controlled indirectly.

Figure 3A:
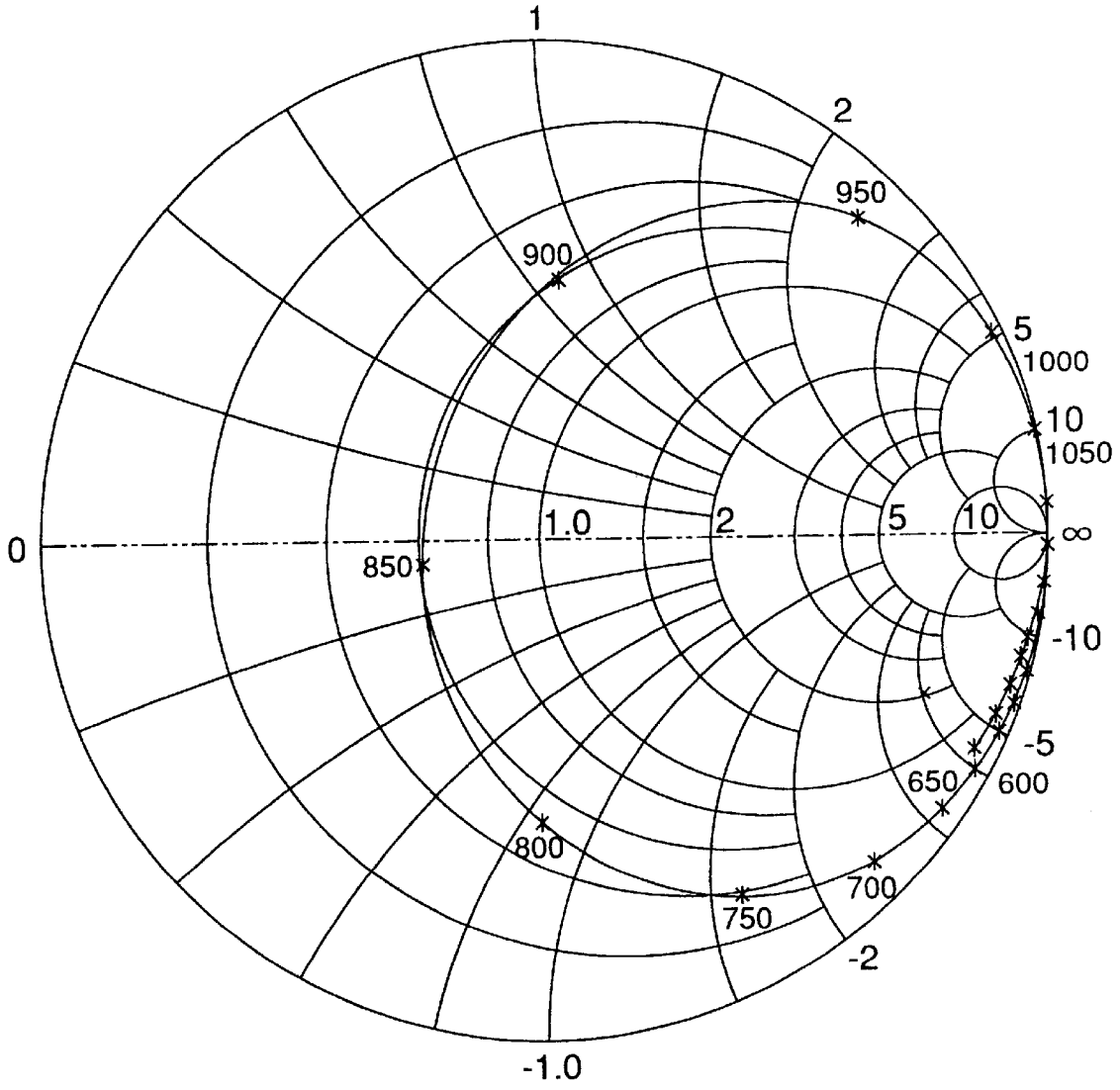
FIG. 3A is a Smith chart illustrating the impedance of the antenna apparatus in accordance with the first embodiment of the present invention.
Figure 3B:
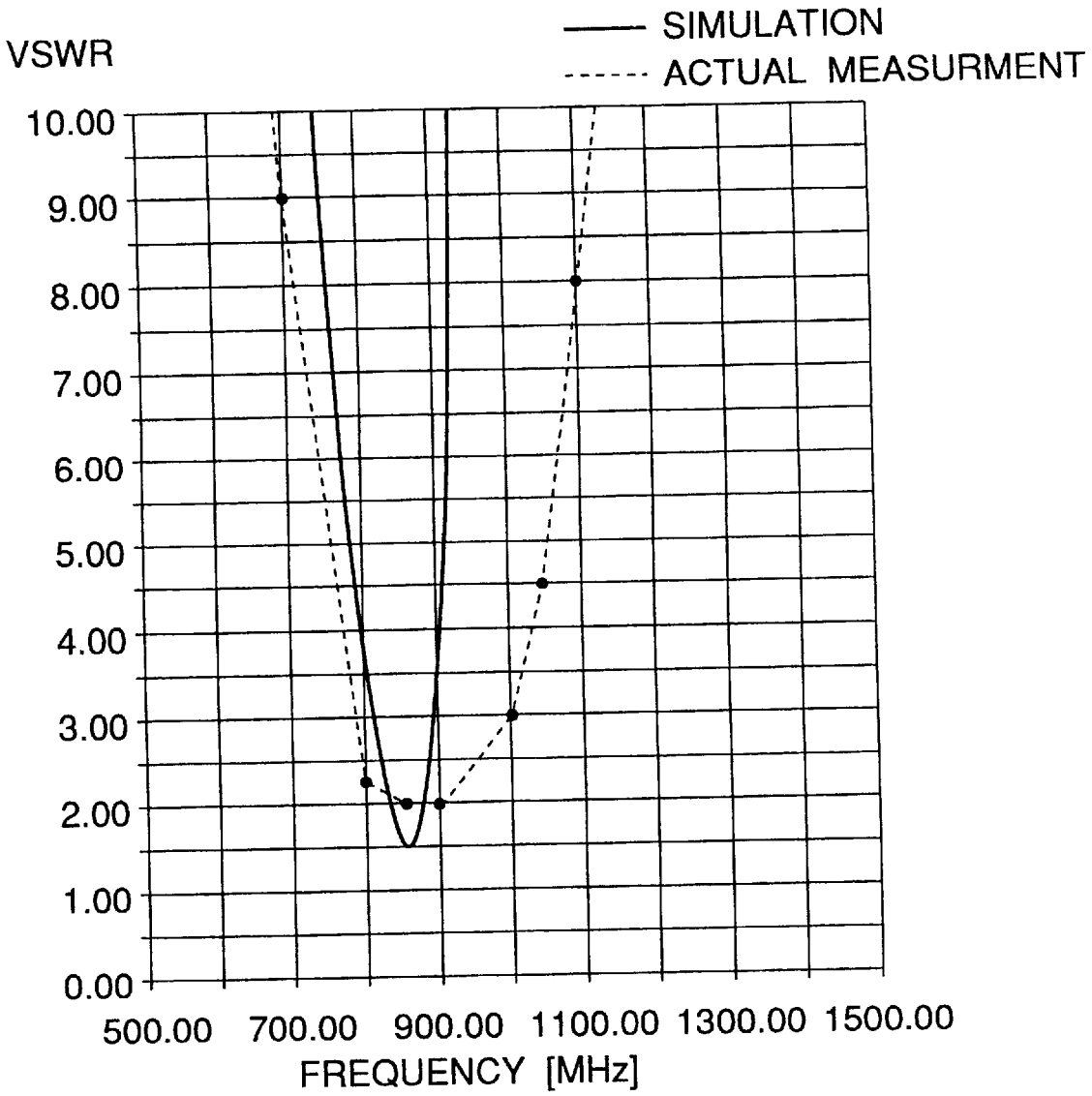
FIG. 3B is a VSWR characteristic diagram of the antenna apparatus in accordance with the first embodiment of the present invention.

FIGS. 3A and 3B explain the operation in accordance with this embodiment, and are diagrams illustrating the impedance characteristic of the helical antenna in the configuration shown in FIG. 2B. FIG. 3A illustrates a Smith chart and shows that the closer to the center of the circle the locus of the impedance of the antenna is, the closer to a desired level the impedance is, and the numerical value adjacent to the asterisk (*) is the frequency [MHz]. In this chart, in the vicinity of the 800 to 900 [MHz] region, the impedance approaches 50 Ω which is the desired level, and it can be appreciated that the band having 850 [MHz] as the center frequency is secured.

FIG. 3B shows a voltage standing wave ratio (VSWR), wherein the abscissa shows the received frequency, while the ordinate shows VSWR. The graph shows that the closer to 1.0 the locus of the impedance of the antenna is as the value of VSWR, the closer to the desired level the impedance is. The solid line shows values which are obtained by simulation, while the dotted line shows values which were confirmed by actual measurement. Although there are slight deviations between the solid line and the dotted line, substantially identical frequency characteristics are obtained, which clearly attests to the validity of numerical analysis.

In this graph as well, in the vicinity of the 800 to 900 [MHz] region, the impedance approaches 50 Ω which is the desired level, and the frequency band A having 850 [MHz] or its vicinity as the center frequency is secured, in the same way as explained with reference to FIG. 3A.

Thus, the helical antenna having the configuration shown in FIG. 2B is capable of respectively independently controlling the impedances in the frequency band A of the helical antenna element 103 without affecting the impedances in the frequency band A of the monopole antenna element 102.

Figure 4:
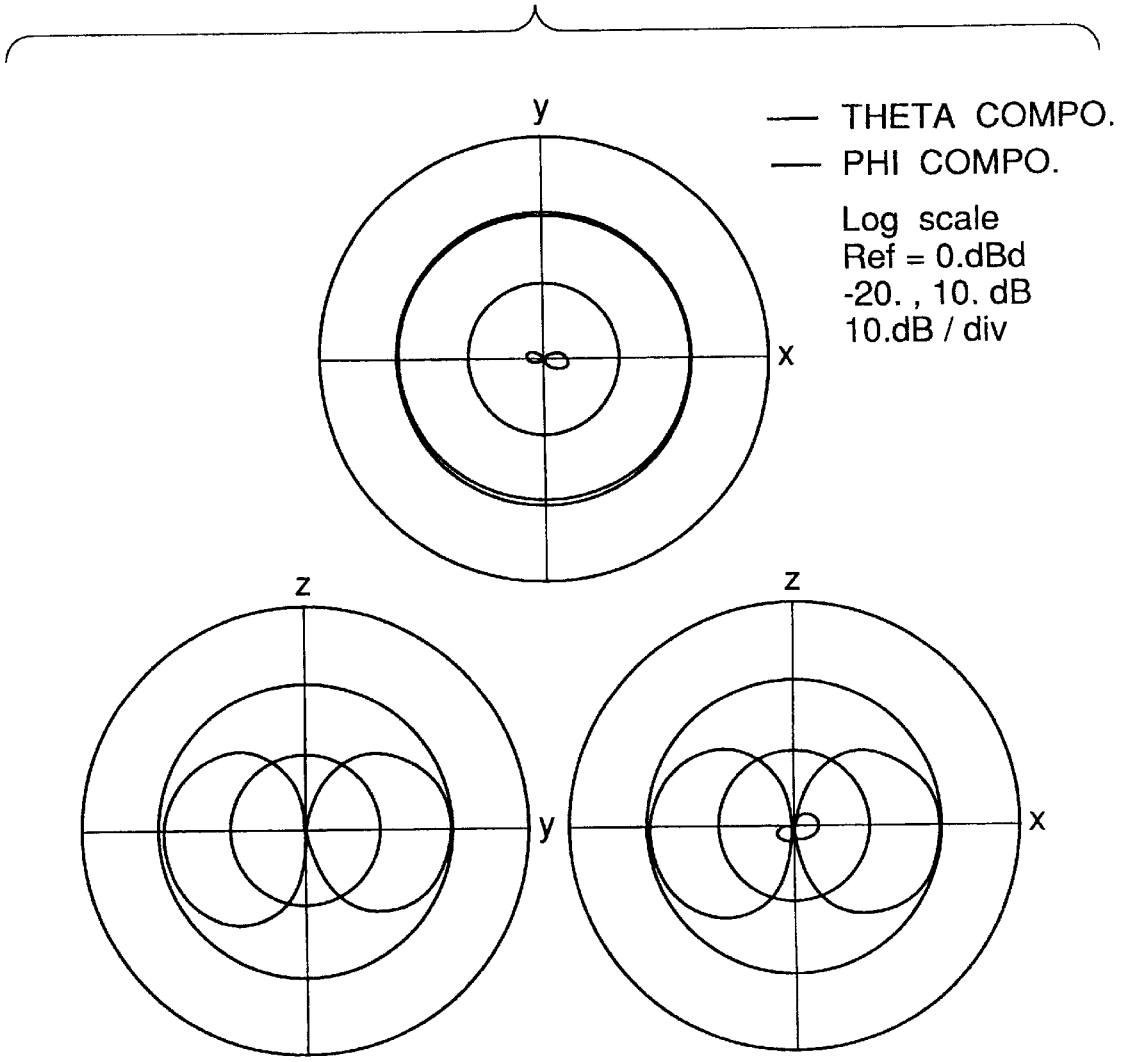
FIG. 4 is a radiation pattern diagram of the antenna apparatus in accordance with the first embodiment of the present invention.

FIG. 4 explains the operation in accordance with this embodiment, and is a radiation pattern diagram illustrating directional characteristics in the frequency band A in the configuration shown in FIG. 2B. It should be noted that the radiation pattern diagram is a diagram which illustrates the directivity, i.e., one of the important characteristics of the antenna, and shows the extent to which the antenna radiates energy in each direction in each plane of XY, YZ, and XZ with the position of the antenna set as an origin. The radiation characteristic in the XY plane shows the isotropic characteristic which is desired for an antenna of a portable radio unit. The fact that an antenna can be provided with a directional characteristic by adding a parasitic element to an antenna element is well known from the example of the Yagi-Uda antenna and the like. In this embodiment, since the spacing between the helical antenna element 103 and the parasitic helical element 104 is sufficiently shorter than the wavelength in the frequency band A, the isotropic characteristic is realized without any addition to the parasitic helical element 104.

Figure 5:
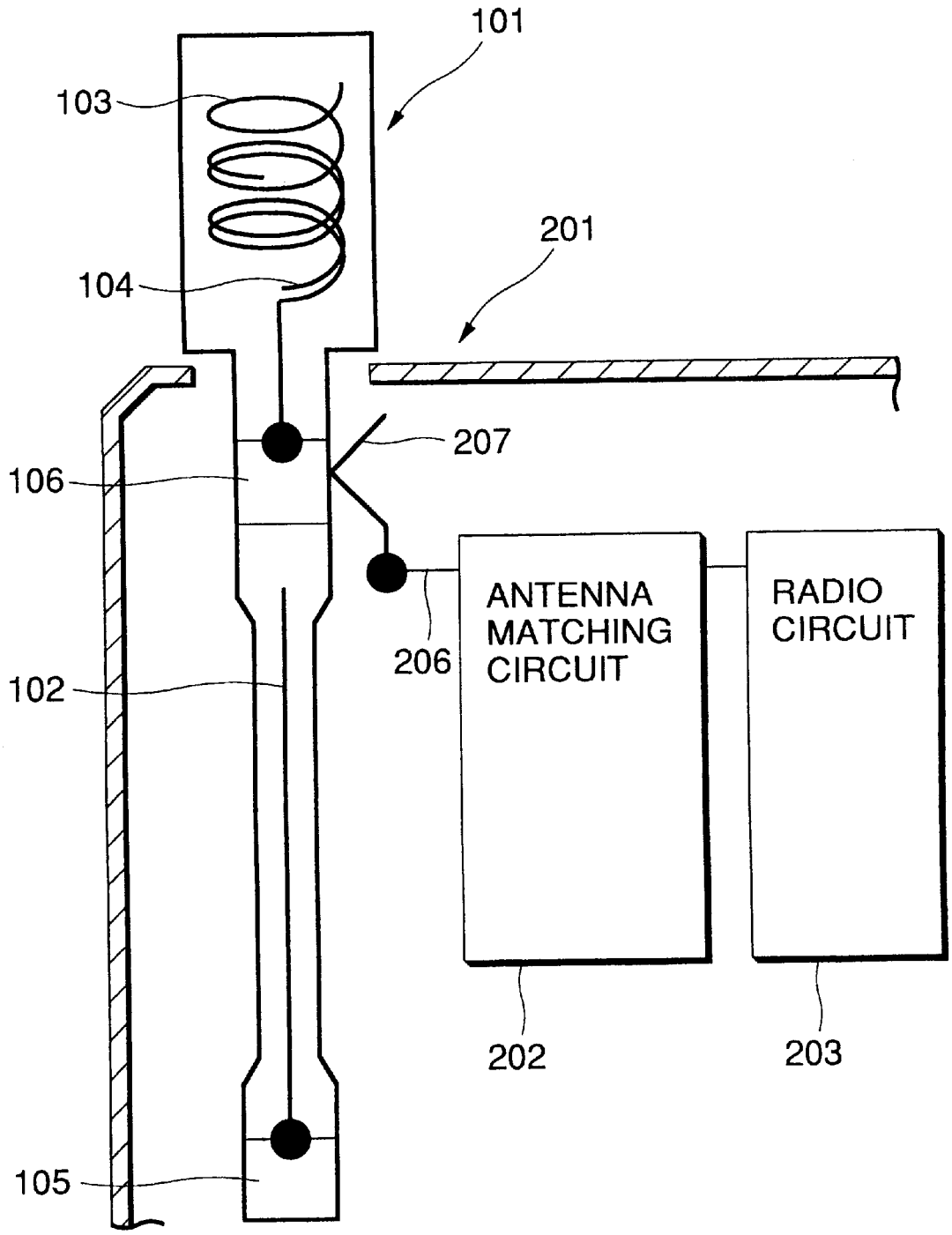
FIG. 5 is a schematic diagram of a radio unit to which the antenna apparatus in accordance with the first embodiment of the present invention is applied.

FIG. 5 is a diagram illustrating a specific configuration in accordance with this embodiment, and shows an example of the configuration of the radio unit in which the antenna apparatus shown in FIG. 1 is mounted. Incidentally, portions which correspond to those of FIG. 1 are denoted by the same reference numerals. The helical antenna element 103 is installed so as to improve the gain of the antenna when the monopole antenna element 102 is accommodated in the main body 201 of the radio unit. When the whip antenna 101 is pulled out from the main body 201 of the radio unit, the monopole antenna element 102 is connected to the radio circuit 203 via the first contact 105, the feeding contact piece 207, the feeder 206, and the antenna matching circuit 202. When the whip antenna 101 is accommodated in the main body 201 of the radio unit, the helical antenna element 103 is connected to the radio circuit 203 via the second contact 106, the feeding contact piece 207, the feeder 206, and the antenna matching circuit 202.

In such a configuration, the impedance when the helical antenna element 103 is viewed from the second contact 106 with the whip antenna 101 accommodated in the main body 201 of the radio unit is assumed to be Z2. Meanwhile, the impedance when the whip antenna 101 is viewed from the first contact 105 with the whip antenna 101 pulled out from the main body 201 of the radio unit is assumed to be Z1, and the intrinsic impedance of the parasitic helical element 104 is controlled such that Z1=Z2. As a result, in the given whip antenna length and the given dimensions of the casing of the radio unit, it is possible to control the impedance of the whip antenna 101 and allow Z1 and Z2 to match in the pulled-out and accommodated states of the whip antenna 101, with the result that a favorable matched state can be obtained, thereby permitting high-quality and stable mobile communication.

Second Embodiment

Figure 6:
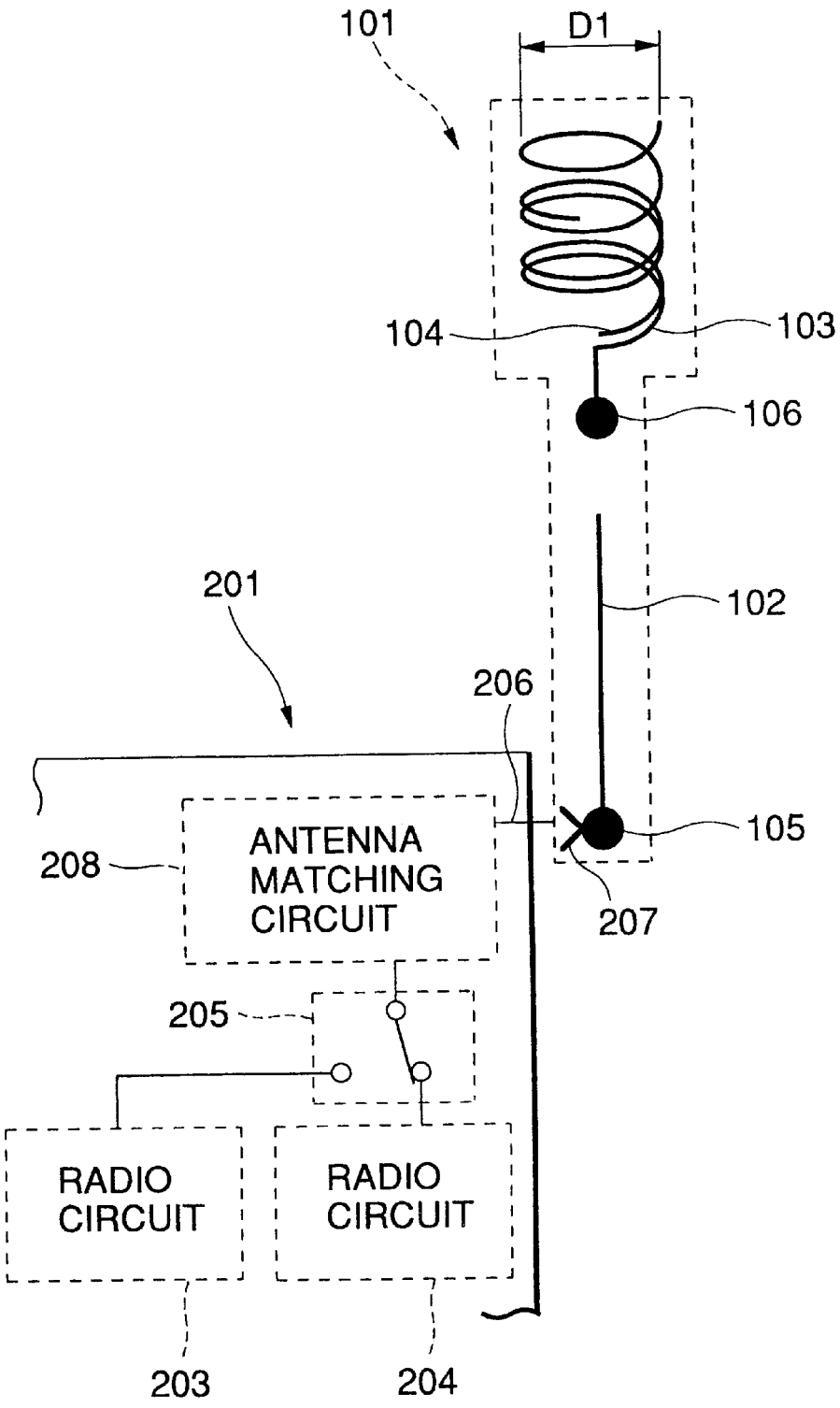
FIG. 6 is a conceptual diagram of an antenna apparatus in accordance with a second embodiment of the present invention.

Next, referring to FIGS. 6 to 10, a description will be given of a second embodiment of the present invention. FIG. 6 shows the configuration of an antenna apparatus in accordance with the second embodiment of the present invention. The whip antenna 101 is constituted by the monopole antenna element 102, the helical antenna element 103, and the parasitic helical element 104. Here, when the whip antenna 101 is extended, the monopole antenna element 102 is connected at the first contact 105 to an antenna matching circuit 208 via the feeding contact piece 207 and the feeder 206. When the whip antenna 101 is accommodated, the helical antenna element 103 is connected at the second contact 106 to the antenna matching circuit 208 via the feeding contact piece 207 and the feeder 206. The antenna matching circuit 208 is connected via a changeover switch 205 to the radio circuit 203 which is operated in the frequency band A or to a radio circuit 204 which is operated in a frequency band B. Further, the antenna matching circuit 208 has a double-hump characteristic of converting the impedance of the monopole antenna element 102 into a desired impedance in the frequency band A and the frequency band B. Furthermore, the antenna matching circuit 208 is capable of causing the impedance of the helical antenna element 103, which occurred due to electrical coupling with the parasitic helical element 104, to match the impedance of the monopole antenna element 102 in the frequency band A and the frequency band B, thereby making it possible to obtain a desired impedance when the whip antenna is accommodated.

FIGS. 7A to 7D explain the operation in accordance with this embodiment, and illustrate distributions of electric current when high-frequency power in the frequency band A and the frequency band B is fed to the whip antenna element 101. Incidentally, portions corresponding to those shown in FIG. 6 are denoted by the same reference numerals. FIG. 7A shows the state in which the whip antenna element 101 is extended, while FIG. 7B shows the state in which the whip antenna element 101 is accommodated, in a case of the frequency band A. Here, reference numeral 201 denotes a metal plate which simulates a casing of the main body of the radio unit and has a height of 129 mm and a width of 32 mm in terms of its dimensions. Further, the monopole antenna element 102 has an element length of 115 mm; the helical antenna element 103 has a coil diameter of 7 mm, a coil pitch of 3 mm, and a coil height of 11.3 mm; and the parasitic helical element 104 has a coil diameter of 7 mm, a coil pitch of 4 mm, and a coil height of 8.1 mm. All of these elements are formed of a metal wire having a diameter of 0.5 mm, and are arranged on the same line. In addition, a center frequency fA of the frequency band A is set at 850 [MHz], and a center frequency fB of the frequency band B is set at 2150 [MHz]. Further, the swollen portion at the slanted-line portion shows the magnitude of electric current on the elements including the monopole antenna element 102 and the helical antenna element 103.

The high-frequency power in the frequency band A fed to the monopole antenna element 102 produces a distribution of electric current in correspondence with its virtual equivalent electrical length. In the case of FIG. 7A, since the virtual equivalent electrical length of the monopole antenna element 102 is a ¼ wavelength, the distribution of electric current at the point of connection to the main body 201 of the radio unit becomes maximum. Similarly, also in the case of FIG. 7B in which the whip antenna element 101 is accommodated, the distribution of electric current of the helical antenna element 103 becomes maximum at the point of connection to the main body 201 of the radio unit due to the effect of the current which is induced in the parasitic helical element 104.

The high-frequency current induced in the parasitic helical element 104 affects the current distribution in the helical antenna element 103 and the impedance thereof. Here, since the amplitude and phase of the high-frequency current can be controlled by the length and pitch of the parasitic helical element 104, the impedance of the helical antenna element 103 can be controlled indirectly.

In the case of FIG. 7C, in the same way as explained with reference to FIG. 7A, as for the high-frequency power in the frequency band B fed to the whip antenna element 101, the distribution of electric current at the point of connection to the main body 201 of the radio unit becomes minimum since the virtual equivalent electrical length of the monopole antenna element 102 is a ½ wavelength. Similarly, also in the case of FIG. 7D in which the whip antenna element 101 is accommodated, in the same way as explained with reference to FIG. 7B, the distribution of electric current of the helical antenna element 103 becomes minimum at the point of connection to the main body 201 of the radio unit due to the effect of the current which is induced in the parasitic helical element 104.

Figure 8A:
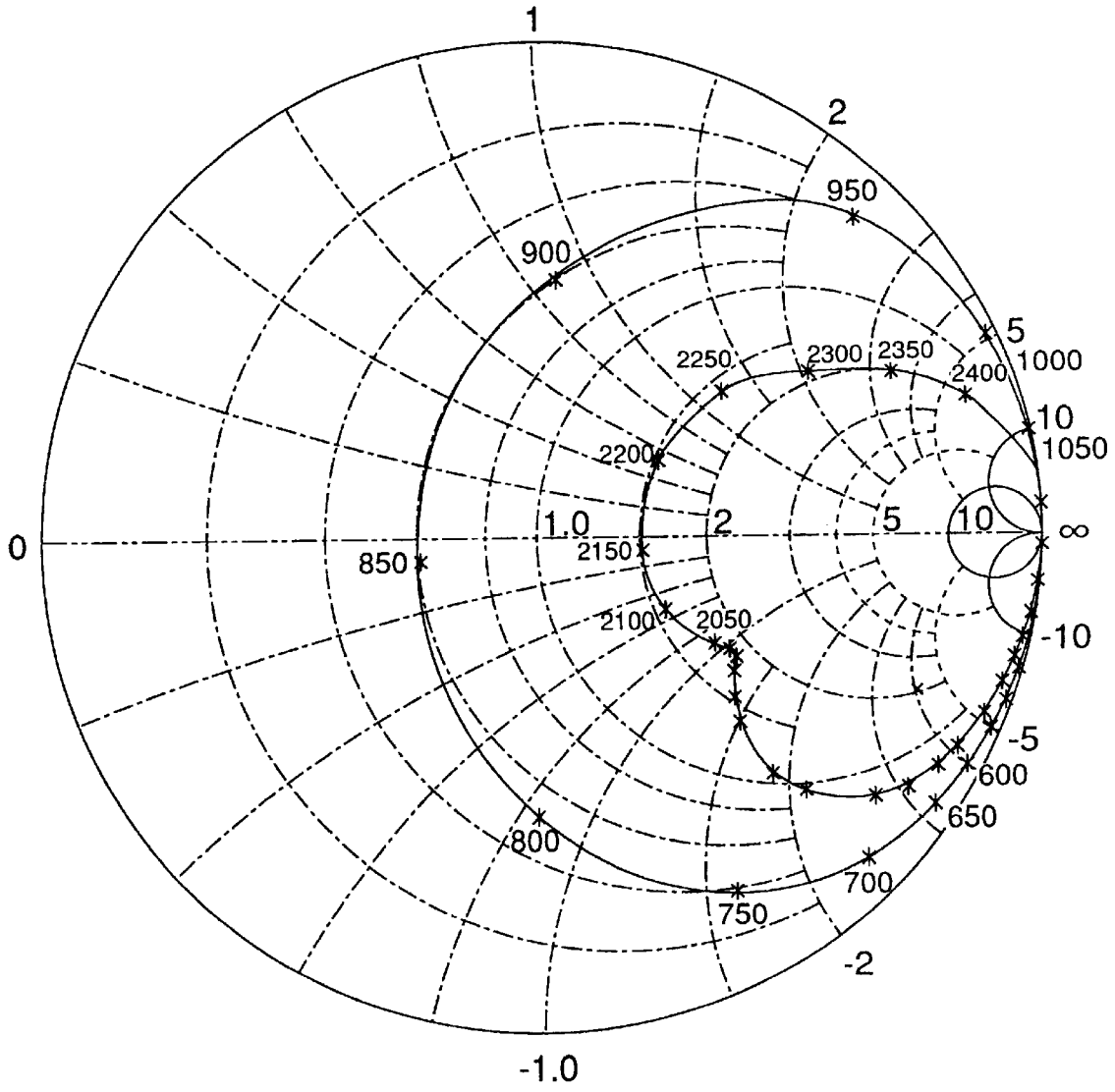
FIG. 8A is a Smith chart illustrating the impedance of the antenna apparatus in accordance with the second embodiment of the present invention.
Figure 8B:
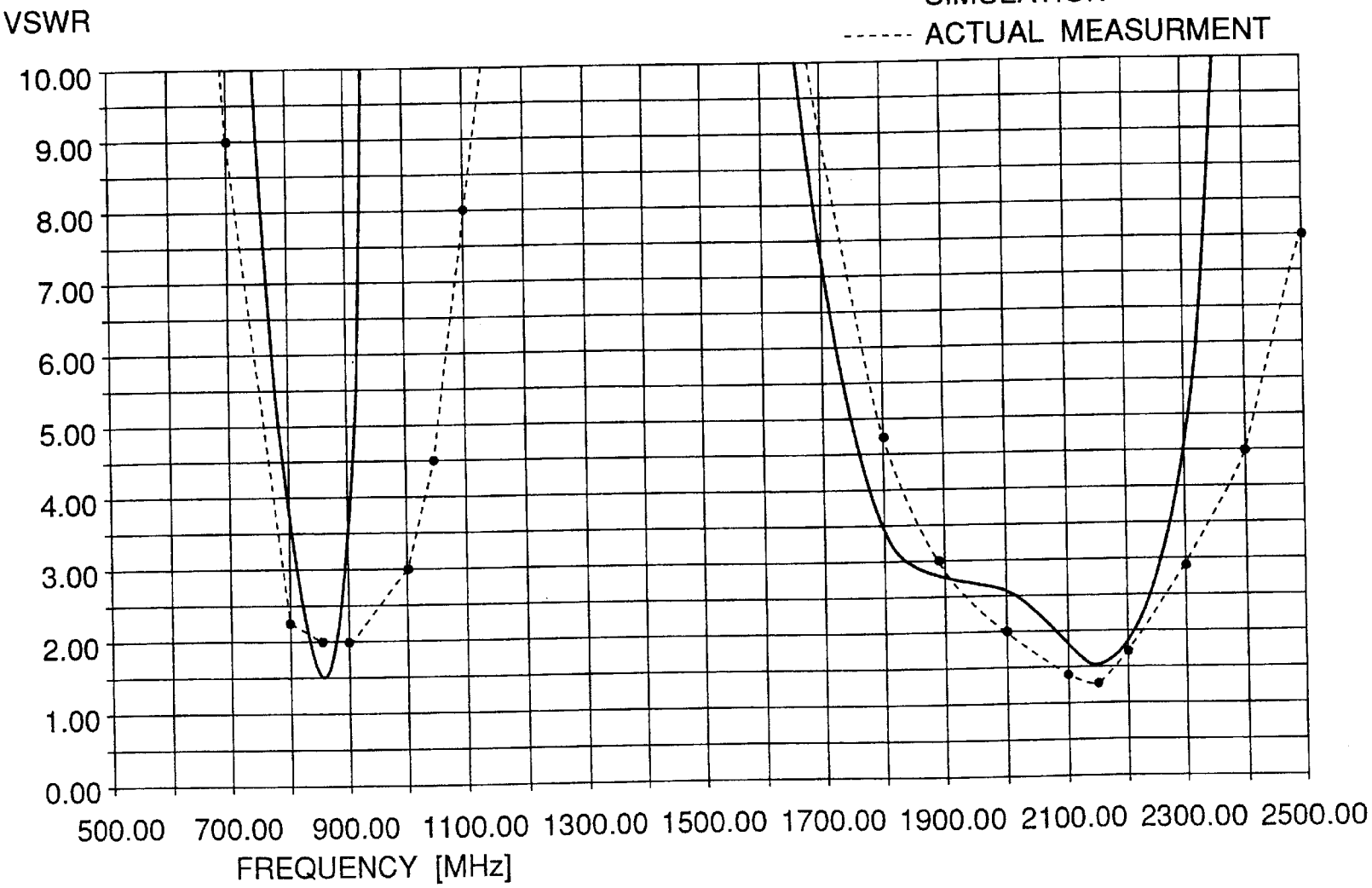
FIG. 8B is a VSWR characteristic diagram of the antenna apparatus in accordance with the second embodiment of the present invention.

FIGS. 8A and 8B explain the operation in accordance with this embodiment, and are diagrams illustrating the impedance characteristic of the helical antenna in the configuration shown in FIG. 7B. FIG. 8A illustrates a Smith chart and shows that the closer to the center of the circle the locus of the impedance of the antenna is, the closer to a desired level the impedance is, and the numerical value adjacent to the asterisk (*) is the frequency [MHz]. In this chart, in the vicinity of the 800 to 900 [MHz] region, the impedance approaches 50 Ω which is the desired level, and it can be appreciated that the band A having 850 [MHz] as the center frequency is secured. Further, in the vicinity of the 2100 to 2200 [MHz] region, the impedance approaches 50 Ω which is the desired level, and it can be appreciated that the band B having 2150 [MHz] as the center frequency is secured.

FIG. 8B shows the voltage standing wave ratio (VSWR), wherein the abscissa shows the received frequency, while the ordinate shows VSWR. The graph shows that the closer to 1.0 the locus of the impedance of the antenna is as the value of VSWR, the closer to the desired level the impedance is. The solid line shows values which are obtained by simulation, while the dotted line shows values which were confirmed by actual measurement. Although there are slight deviations between the solid line and the dotted line, substantially identical frequency characteristics are obtained, which clearly attests to the validity of numerical analysis.

In this graph as well, in the vicinity of the 800 to 900 [MHz] region, the impedance approaches 1.0 Ω as the value of VSWR, and it can be appreciated that the frequency band A having 850 [MHz] or its vicinity as the center frequency is secured, in the same way as explained with reference to FIG. 8(*a*). Further, in the vicinity of the 2100 to 2200 [MHz] region, the impedance approaches 1.0 W as the value of VSWR, and it can be appreciated that the frequency band B having 2150 [MHz] or its vicinity as the center frequency is secured.

Thus, the helical antenna having the configuration shown in FIG. 7B is capable of respectively independently controlling the impedances in the frequency band A and the frequency band B of the helical antenna element 103 without affecting the impedances in the frequency band A and the frequency band B of the monopole antenna element 102.

Figure 9A:
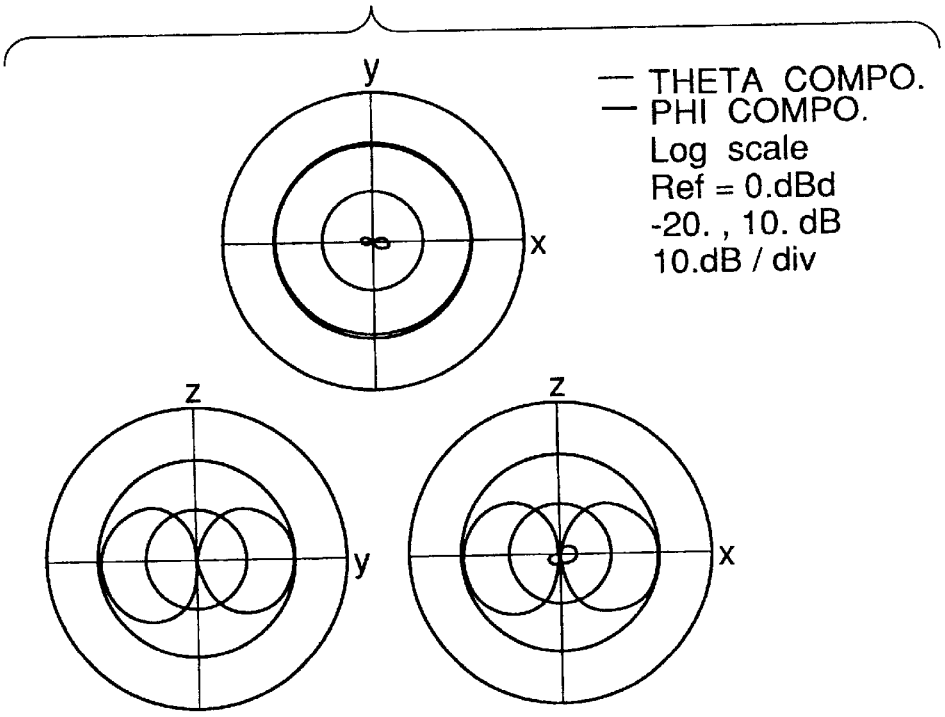
FIGS. 9A and 9B are radiation pattern diagrams of the antenna apparatus in accordance with the second embodiment of the present invention.
Figure 9B:
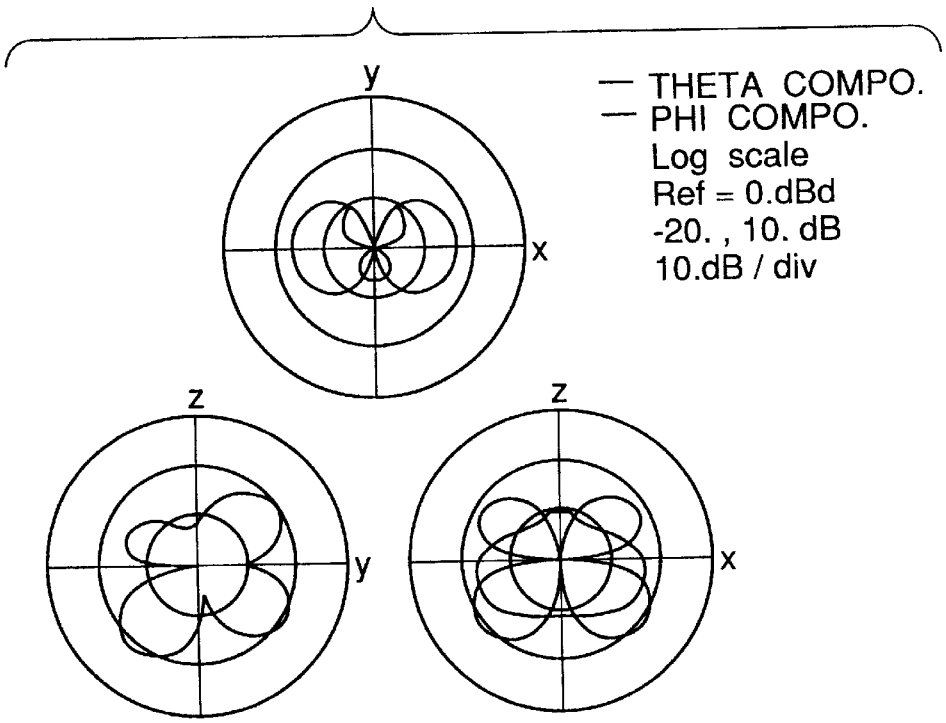

FIGS. 9A and 9B explain the operation in accordance with this embodiment, and are radiation pattern diagrams illustrating directional characteristics in the frequency band A and the frequency band B in the configuration shown in FIG. 7B. FIG. 9A shows the characteristic in the frequency band A, while FIG. 9B shows the characteristic in the frequency band B. The radiation characteristic in the XY plane shows the isotropic characteristic which is desired for an antenna of a portable radio unit in the frequency band A. Even with the butterfly-shaped radiation pattern having nulls in the X-axis direction in the XZ plane or the YZ plane as shown in FIG. 9(*b*), the portable radio unit is used by being inclined when the user is engaged in a conversation. In such a state, the antenna still exhibits directivity in the horizontal direction, so that it can be said that the directional characteristic desired for an antenna for the portable radio unit is provided.

Figure 10:
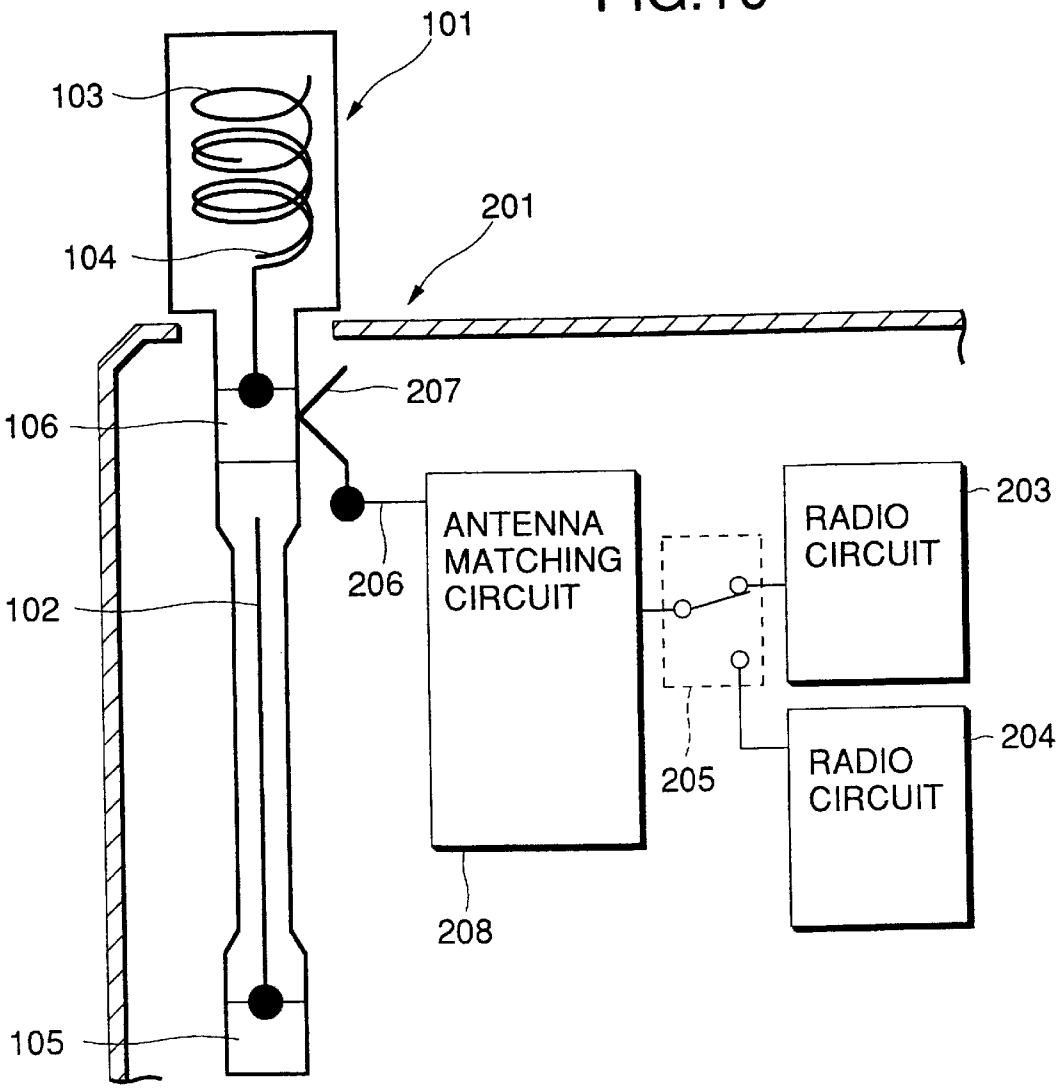
FIG. 10 is a schematic diagram of the radio unit to which the antenna apparatus in accordance with the second embodiment of the present invention is applied.

FIG. 10 is a diagram illustrating a specific configuration in accordance with this embodiment, and shows an example of the configuration of the radio unit on which the antenna apparatus shown in FIG. 6 is mounted. Incidentally, portions which correspond to those of FIG. 6 are denoted by the same reference numerals. The helical antenna element 103 is installed so as to improve the gain of the antenna when the monopole antenna element 102 is accommodated in the main body 201 of the radio unit. When the whip antenna 101 is pulled out from the main body 201 of the radio unit, the monopole antenna element 102 is connected to the radio circuit 203 via the first contact 105, the feeding contact piece 207, the feeder 206, and the antenna matching circuit 208. When the whip antenna 101 is accommodated in the main body 201 of the radio unit, the helical antenna element 103 is connected to the radio circuit 203 via the second contact 106, the feeding contact piece 207, the feeder 206, and the antenna matching circuit 208.

In such a configuration, the impedances in the frequency band A and the frequency band B when the helical antenna element 103 is viewed from the second contact 106 with the whip antenna 101 accommodated in the main body 201 of the radio unit are assumed to be Z2(A) and Z2(B). Meanwhile, the impedances when the whip antenna 101 is viewed from the first contact 105 with the whip antenna 101 pulled out from the main body 201 of the radio unit are assumed to be Z1 (A) and Z2(B), and the intrinsic impedance of the helical antenna element 103 is controlled by means of the parasitic helical element 104 such that Z1(A)=Z2(A), and Z1(B)=Z2(B). As a result, in the given whip antenna length and the given dimensions of the casing of the radio unit, it is possible to control the impedance of the whip antenna 101 and ensure that Z1(A)=Z2(A), and Z1(B)=Z2(B). Consequently, it is possible to obtain a favorable matched state in both bands of the frequency band A and the frequency band B, thereby permitting high-quality and stable mobile communication.

Third Embodiment

Figure 11:
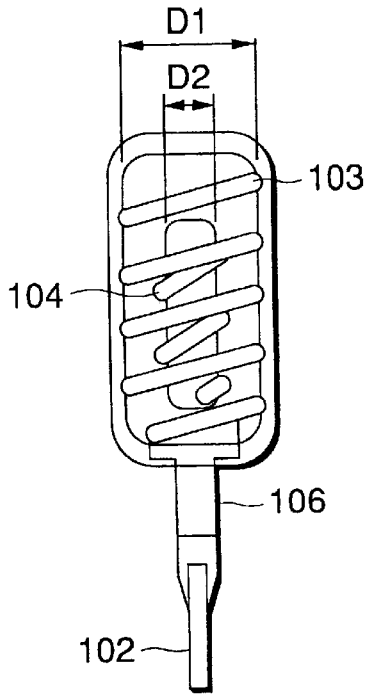
FIG. 11 is a partial schematic diagram of an antenna apparatus in accordance with a third embodiment of the present invention.

Next, referring to FIG. 11, a description will be given of a third embodiment of the present invention. FIG. 11 shows the configuration of a whip antenna in accordance with this embodiment, and portions corresponding to those of FIG. 6 are denoted by the same reference numerals. It should be noted that although, in the following description, a description is given by assuming that the center frequency of the frequency band A is fA, and that the center frequency of the frequency band B is fB, such that fA<fB, even if the setting is provided such that fA>fB, the embodiment can be applied as it is. The whip antenna 101 is constituted by the monopole antenna element 102, the helical antenna element 103, and the parasitic helical element 104. The method of connection to the radio circuit and other arrangements are similar to those described with reference to FIG. 6.

Since the coil diameter D2 of the parasitic helical element 104 is smaller than the coil diameter D1 of the helical antenna element 103, the parasitic helical element 4 is disposed on the inner side. Consequently, since the coil pitch of the parasitic helical element 104 and the coil pitch of the helical antenna element 103 can be selected freely, it is possible to control the phase of the induced current. In addition, by changing the difference (D1−D2) between the coil diameter D1 and the coil diameter D2, it is possible to more finely control the magnitude of the current induced in the parasitic helical element 104. For instance, if such a coil length that the virtual equivalent electrical length corresponding to the frequency band A becomes a ¼ wavelength is selected for the helical antenna element 103. If such a coil length that the virtual equivalent electrical length corresponding to the frequency band B becomes a ¼ wavelength is selected for the parasitic helical element 104, the helical antenna element 103 can be provided with an impedance characteristic which covers the respective frequency bands.

Fourth Embodiment

Figure 12:
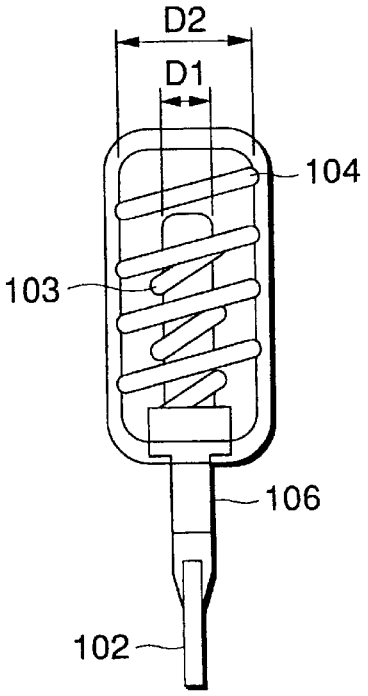
FIG. 12 is a partial schematic diagram of an antenna apparatus in accordance with a fourth embodiment of the present invention.
Figure 13:
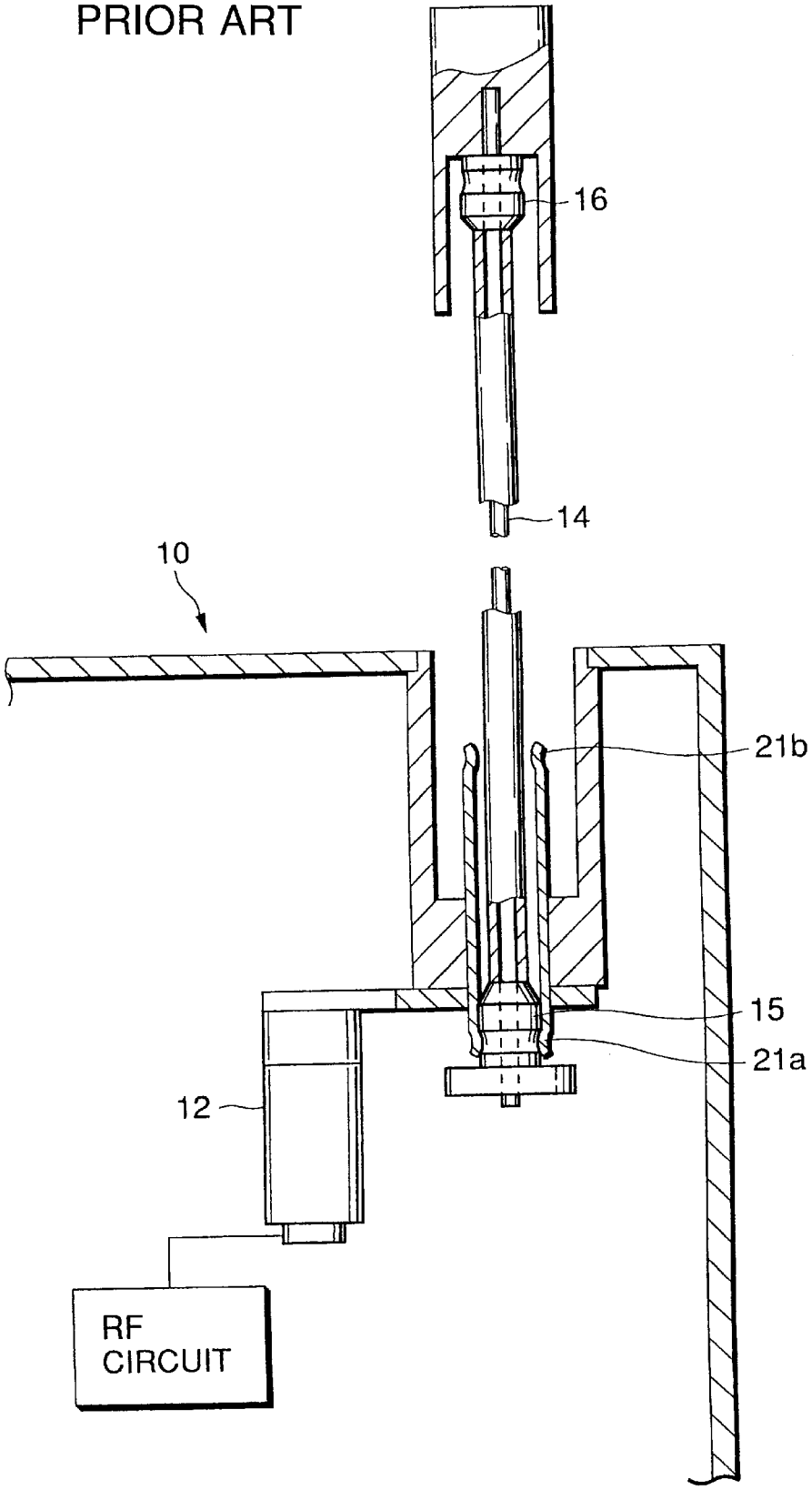
FIG. 13 PRIOR ART
FIG. 13 is a schematic diagram illustrating a conventional antenna.
Figure 14:
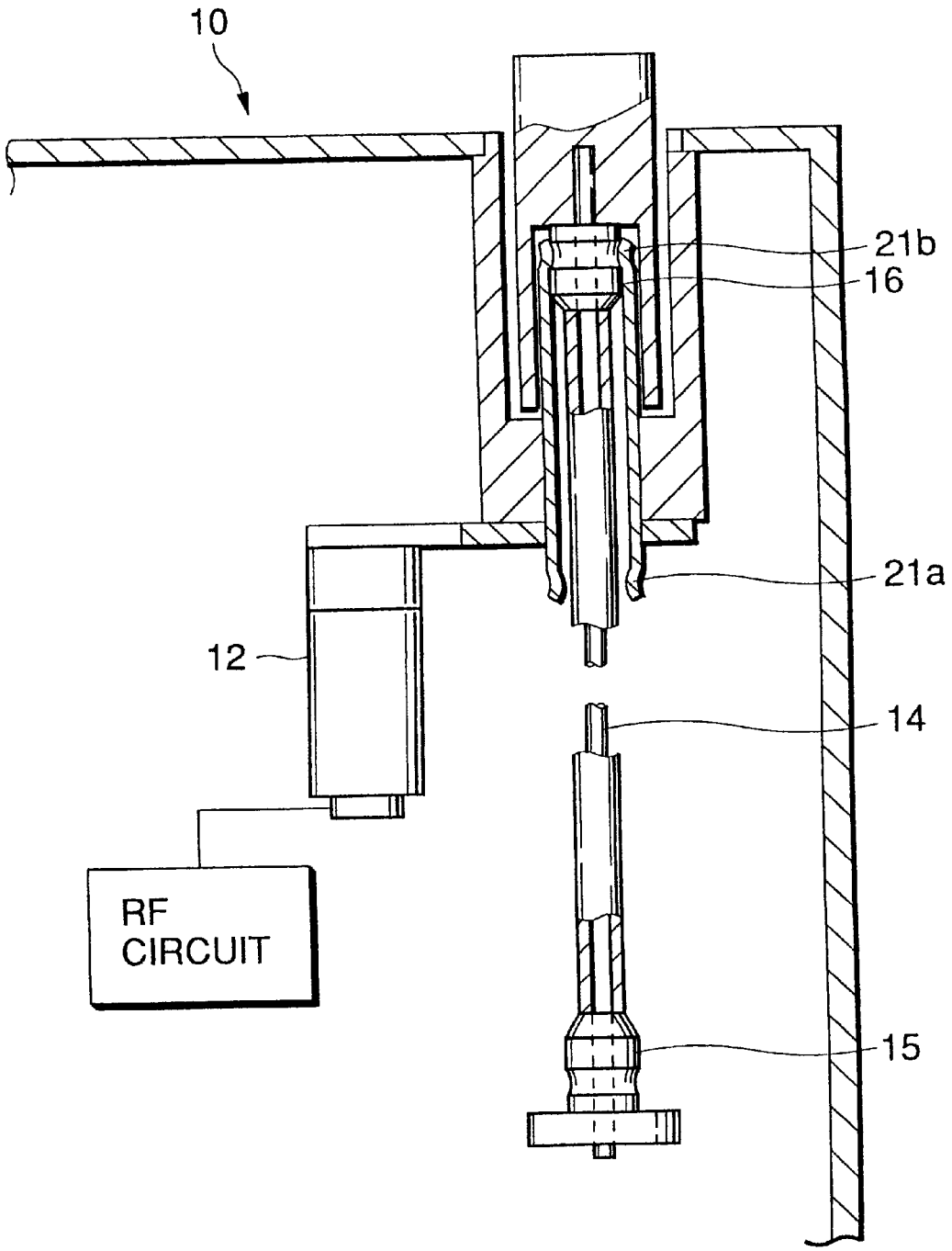
FIG. 14 PRIOR ART
FIG. 14 is a schematic diagram illustrating the conventional antenna.
Figure 15:
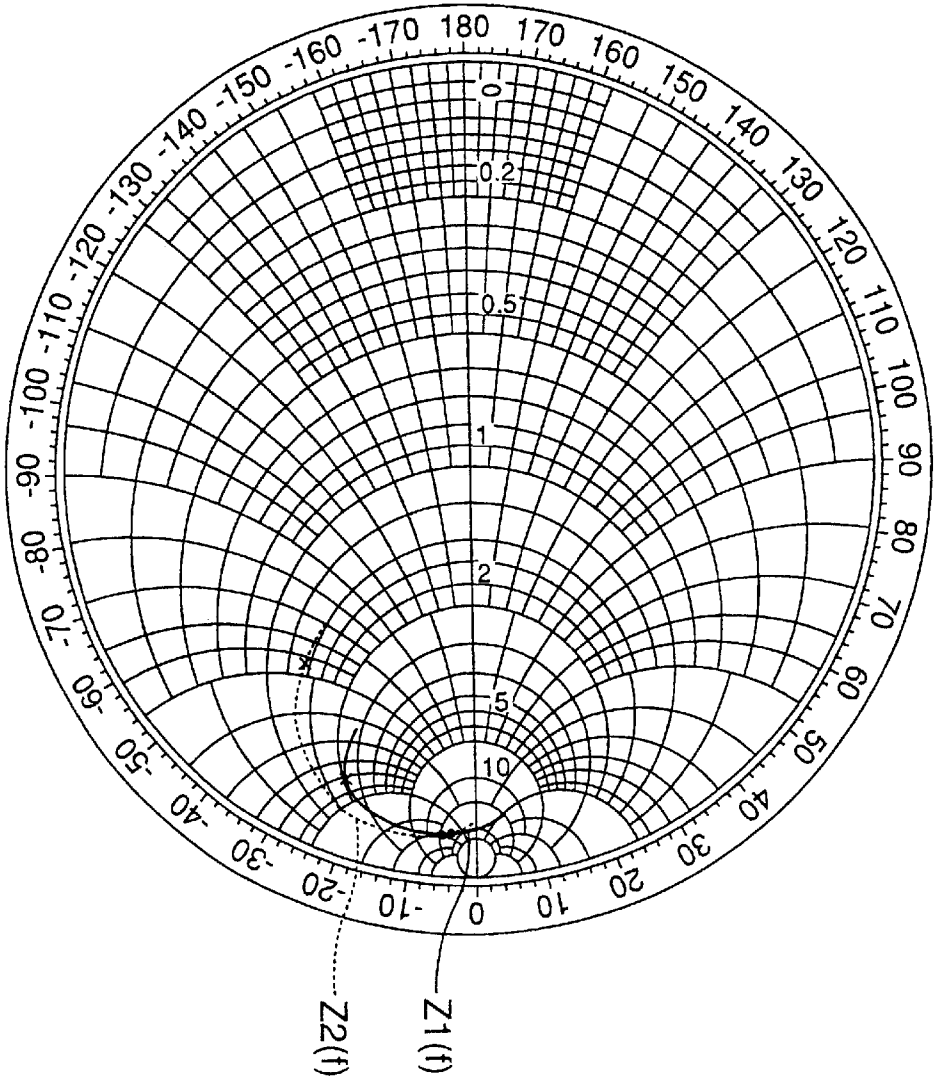
FIG. 15 PRIOR ART
FIG. 15 is a Smith chart illustrating the impedance of the conventional antenna apparatus.

Next, referring to FIG. 12, a description will be given of a fourth embodiment of the present invention. FIG. 12 shows the configuration of a whip antenna in accordance with this embodiment, and portions corresponding to those of FIG. 6 are denoted by the same reference numerals. It should be noted that although, in the following description, a description is given by assuming that the center frequency of the frequency band A is fA, and that the center frequency of the frequency band B is fB, such that fA<fB, even if the setting is provided such that fA>fB, the embodiment can be applied as it is. The whip antenna 101 is constituted by the monopole antenna element 102, the helical antenna element 103, and the parasitic helical element 104. The method of connection to the radio circuit and other arrangements are similar to those described with reference to FIG. 6.

Since the coil diameter D2 of the parasitic helical element 104 is larger than the coil diameter D1 of the helical antenna element 103, the parasitic helical element 4 is disposed on the outer side. Consequently, since the coil pitch of the parasitic helical element 104 and the coil pitch of the helical antenna element 103 can be selected freely, it is possible to control the phase of the induced current. In addition, by changing the difference (D1−D2) between the coil diameter D1 and the coil diameter D2, it is possible to more finely control the magnitude of the current induced in the parasitic helical element 104. For instance, if such a coil length that the virtual equivalent electrical length corresponding to the frequency band A becomes a ¼ wavelength is selected for the parasitic helical element 104, and if such a coil length that the virtual equivalent electrical length corresponding to the frequency band B becomes a ¼ wavelength is selected for the helical antenna element 103, the helical antenna element 103 can be provided with an impedance characteristic which covers the respective frequency bands.

What is claimed is:

1. An antenna apparatus for use in a compact portable radio, said apparatus including a telescopic whip antenna corresponding to first and second frequency bands, said whip antenna being movable between a position extended from a body of said radio and a position accommodated in the body of said radio, comprising:

a monopole antenna element connected to an antenna matching circuit via a first contact when said whip antenna is extended;

a helical antenna element connected to said antenna matching circuit via a second contact when said whip antenna is accommodated;

a parasitic helical element, said parasitic helical element being disposed a distance from said helical antenna element, said distance being smaller than a wavelength of said first frequency band, and wherein said parasitic helical element remains said distance from said helical antenna element as said whip antenna is moved between said extended and accommodated positions.

2. The antenna apparatus according to claim 1, wherein said parasitic helical element is disposed on an inner side of said helical antenna element.

3. The antenna apparatus according to claim 1, wherein said parasitic helical element is disposed on an outer side of said helical antenna element.

4. The antenna apparatus according to claim 1, wherein an impedance of said parasitic helical element is adjusted such that a first impedance of said helical antenna elements, with said whip antenna accommodated, matches a second impedance of said monopole antenna element, with said whip antenna extended, in both the first frequency band and the second frequency band.

5. The antenna apparatus according to claim 4, wherein said parasitic helical element is disposed on an inner side of said helical antenna element.

6. The antenna apparatus according to claim 4, wherein said parasitic helical element is disposed on an outer side of said helical antenna element.

* * * * *

UNITED STATES PATENT AND TRADEMARK OFFICE

CERTIFICATE OF CORRECTION

PATENT NO. : 5,982,330

DATED : November 9, 1999

INVENTOR(S) : Koyanagi et al.

It is certified that error appears in the above-indentified patent and that said Letters Patent is hereby corrected as shown below:

Column 2, Line 5, delete "X $-^{\infty}$" and insert --X = $-^{\infty}$--.

Column 5, Line 53, delete "20".

Column 12, Line 9, Claim 4, delete "elements," and insert --element,--.

Signed and Sealed this

Twenty-fifth Day of July, 2000

*Attest:*

*Attesting Officer*

Q. TODD DICKINSON

*Director of Patents and Trademarks*